US005771803A

United States Patent [19]

Takami

[11] Patent Number: 5,771,803

[45] Date of Patent: Jun. 30, 1998

[54] TAPE CASSETTE HOUSING THERMALLY PERFORATABLE STENCIL PAPER

[75] Inventor: Hiroshi Takami, Nagoya, Japan

[73] Assignee: Brother Kogyo Kabushiki Kaisha, Nagoya, Japan

[21] Appl. No.: 714,811

[22] Filed: Sep. 17, 1996

[30] Foreign Application Priority Data

Sep. 25, 1995 [JP] Japan ..... 7-246205

[51] Int. Cl.[6] ..... B05C 17/06

[52] U.S. Cl. ..... 101/128.21; 400/613; 400/120.13; 400/208; 347/193

[58] Field of Search ..... 101/128.21, 128.4, 101/129, DIG. 46; 400/613, 613.1, 208, 120.13; 347/193

[56] References Cited

U.S. PATENT DOCUMENTS

| | | | |
|---|---|---|---|
| 5,203,951 | 4/1993 | Hattori et al. | 400/613 |
| 5,253,581 | 10/1993 | Miki et al. | 101/121 |
| 5,551,337 | 9/1996 | Miki et al. | 101/128.4 |
| 5,621,452 | 4/1997 | Okumura | 347/171 |

FOREIGN PATENT DOCUMENTS

| | | | |
|---|---|---|---|
| 0013193 | 2/1981 | Japan | 400/208 |
| 61-206673 | 9/1986 | Japan . | |
| 4-33540 | 3/1992 | Japan . | |
| A-4-347681 | 12/1992 | Japan . | |
| 7-32572 | 2/1995 | Japan . | |
| 7-117212 | 5/1995 | Japan . | |
| A-7-156360 | 6/1995 | Japan . | |

*Primary Examiner*—Christopher A. Bennett
*Attorney, Agent, or Firm*—Oliff & Berridge, P.L.C.

[57] ABSTRACT

A tape cassette used in a tape printer, the tape cassette including a thermal stencil paper thermally perforatable by a thermal print head of the tape printer; and a stencil sheet case housing the thermal stencil paper and having a portion shaped the same as a mountable portion of a print tape case housing a print tape. The cassette also includes an indicator for indicating when thermal stencil paper is housed in the cassette.

10 Claims, 9 Drawing Sheets

TAPE CASSETTE HOUSING THERMALLY PERFORATABLE STENCIL PAPER

BACKGROUND OF THE INVENTION

1. Field of the Invention

The present invention relates to a tape cassette used in a tape printer.

2. Description of the Related Art

Conventionally, there has been known a stamp producing device for producing stencil stamps from thermal stencil paper and a stamper. The stamper includes a base member; an ink-impregnated body set to the lower surface of the base member; a pad portion formed by covering the lower surface of the ink-impregnated body with the thermal stencil paper; and a grip freely detachably mounted to the pad portion. The stamp producing device includes a keyboard serving as an input device; a liquid crystal display serving as a display device; and a thermal head for perforating holes in the thermal stencil paper. The stamper is mounted in the stamp producing device and the thermal head perforates the patterns in the thermal stencil paper to form a stamp print surface.

In order to print an image using the stamper, a user presses the stamp print surface of the stamper against a sheet to be printed on. Ink from the impregnated body seeps through holes perforated in the thermal stencil paper and clings to the print sheet, thereby forming an ink image.

The liquid crystal display used with the stamp producing device is comparatively small, because the stamp producing device itself is small. Because the liquid crystal display is small, it is impossible for a user to confirm the entire image that he or she has prepared using the keyboard of the stamp producing device. The user, therefore, first prints the image onto special thermal paper to confirm the accuracy of the inputted image.

SUMMARY OF THE INVENTION

However, the stamper is assembled so that the ink-impregnated body and the thermal stencil paper are inseparable from a frame surrounding these two components. When it becomes necessary to change the stencil paper, for example, to produce a new stamp print surface or when the thermal stencil paper with the print surface is torn, it becomes necessary to change also the ink-impregnated body and the frame.

A special stamp device is necessary to produce the stamper. Further, a special thermal sheet is required to confirm that the stamp print surface is as desired.

It is an objective of the present invention to overcome the above described problems and provide a tape cassette usable in a tape printer capable of producing a desired stamp so that a special stamp producing device is not necessary.

A tape cassette according to the present invention is used in a tape printer including a cassette mounting portion for detachably receiving a tape cassette having a case and a print tape, the case housing the print tape and having a portion shaped mountable in the cassette mounting portion; a thermal print means provided in the tape mounting portion and for printing characters and symbols on the print tape; and a transport means for transporting the print tape. In order to achieve the above-described objectives, the tape cassette itself includes a thermal stencil paper thermally perforatable by the thermal print means; and a case housing the thermal stencil paper and having a portion shaped the same as the mountable portion of the case housing the print tape.

According to another aspect of the present invention the tape cassette includes a thermal stencil paper thermally perforatable by the thermal print means; a case housing the thermal stencil paper; and an indication means formed in the case and for indicating to the tape printer that the thermal stencil paper is housed in the case.

A combination of a tape printer and tape cassettes used in the tape printer according to the present invention includes a first tape cassette having a print tape; and a case housing the print tape and having a portion with a predetermined shape; a second tape cassette having a thermal stencil paper; and a case housing the thermal stencil paper and having a portion with the predetermined shape; and a tape printer having a cassette mounting portion for detachably receiving the portions with the predetermined shape; a thermal print means provided in the tape mounting portion and for thermally printing characters and symbols on the print tape and thermally perforating characters and symbols in the thermal stencil paper; and a transport means for transporting the print tape in the first tape cassette and the thermal stencil paper in the second tape cassette.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
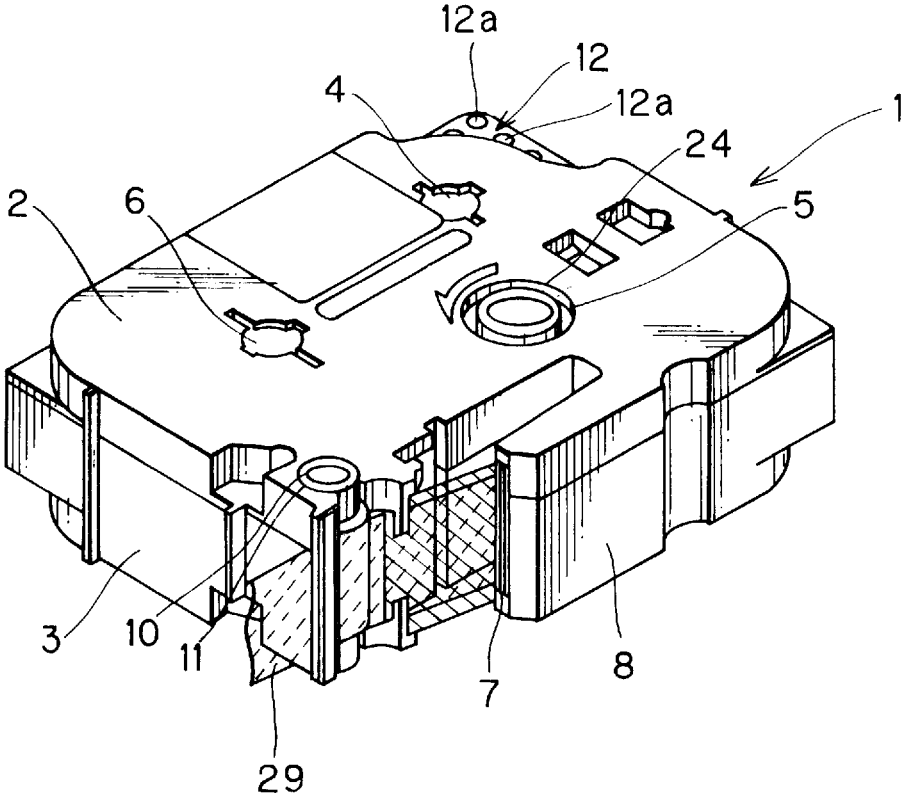
FIG. 1 is a perspective view showing a tape cassette used in a tape printer.

A tape cassette and tape printer according to a preferred embodiment of the present invention will be described while referring to the accompanying drawings wherein like parts and components are designated by the same reference numerals to avoid duplicating description.

A tape printing system according to the present invention will be described while referring to FIGS. 1 to 8. As shown in FIG. 1, a print cassette 1 includes an upper case 2 and a lower case 3. The print cassette 1 is formed with support holes 4, 5, and 6. The support hole 4 is for pivotably supporting a tape spool 21 around which is wrapped a film tape 20. The support hole 5 is for supporting a ribbon take-up spool 24 around which is wound up an ink ribbon 22 drawn out from a ribbon spool 23 when characters, symbols, and the like are printed on the film tape 20 by a thermal head 41 provided in the tape printer 30 (to be described later). The support hole 6 pivotably supports a tape spool 28 around which is wrapped a two-sided adhesive tape 25 formed from a base member, an adhesive layer formed on both surfaces of the base member, and a peel-away sheet attached to one surface of the base member, the two-sided adhesive tape 25 being wrapped around the tape spool 28 so that the peel-away sheet faces outward.

It should be noted that although only the support holes 4, 5, and 6 formed in the upper surface of the upper case 2 are shown in FIG. 1, support holes 4, 5, and 6 are also formed in the lower surface of the lower case 3 in the same manner as describe above in opposition to the support holes 4, 5, and 6 formed in the upper case 2.

An arm portion 8 is provided in the front surface of the print cassette 1. The arm portion 8 serves as a guide for guiding the film tape 20 drawn from the tape spool 21 and the ink ribbon 22 drawn from the ribbon spool 23 toward an opening portion 7. A head mounting portion 9 is opened to the rear of the arm portion 8. As will be described later, a thermal head 41 of the printer 30 is mounted in the head mounting portion 9.

A tape feed roller 10 is rotatably supported in a support hole 11 at a position downstream from the mounting portion 9 with respect to a transport direction of the film tape 20 and the ink ribbon 22. The tape feed roller 10 operates in cooperation with a pressing roller 47, which is provided at a position of the tape printer 30 in confrontation with the tape feed roller 10, to guide the film tape 20 from the tape spool 21 and the two-sided adhesive tape 25 from the tape spool 28. The tape feed roller 10 and the pressing roller 47 adhere the two-sided adhesive tape 25 to the film tape 20 after the film tape 20 has been printed on with characters and symbols via the thermal head 41 and the ink ribbon 22.

There are many types of print cassette available with a variety of different film tapes 20 and with a variety of different colored ink ribbons 22. A cassette detection portion 12 formed with a plurality of switch holes 12*a* in a predetermined pattern for detecting a type of print cassette is provided to the rear right edge of the print cassette 1. The pattern in which the switch holes 12*a* are formed depends on the type of the print cassette 1. As will be described in detail later, the switch holes 12*a* operate in cooperation with a plurality of detection switches disposed in the tape printer 30. The pattern of the switch holes 12*a* produces a combination of ON and OFF signals at the detection switches so that the tape printer 30 can detect the type of print cassette mounted in the tape printer 30.

Figure 2:
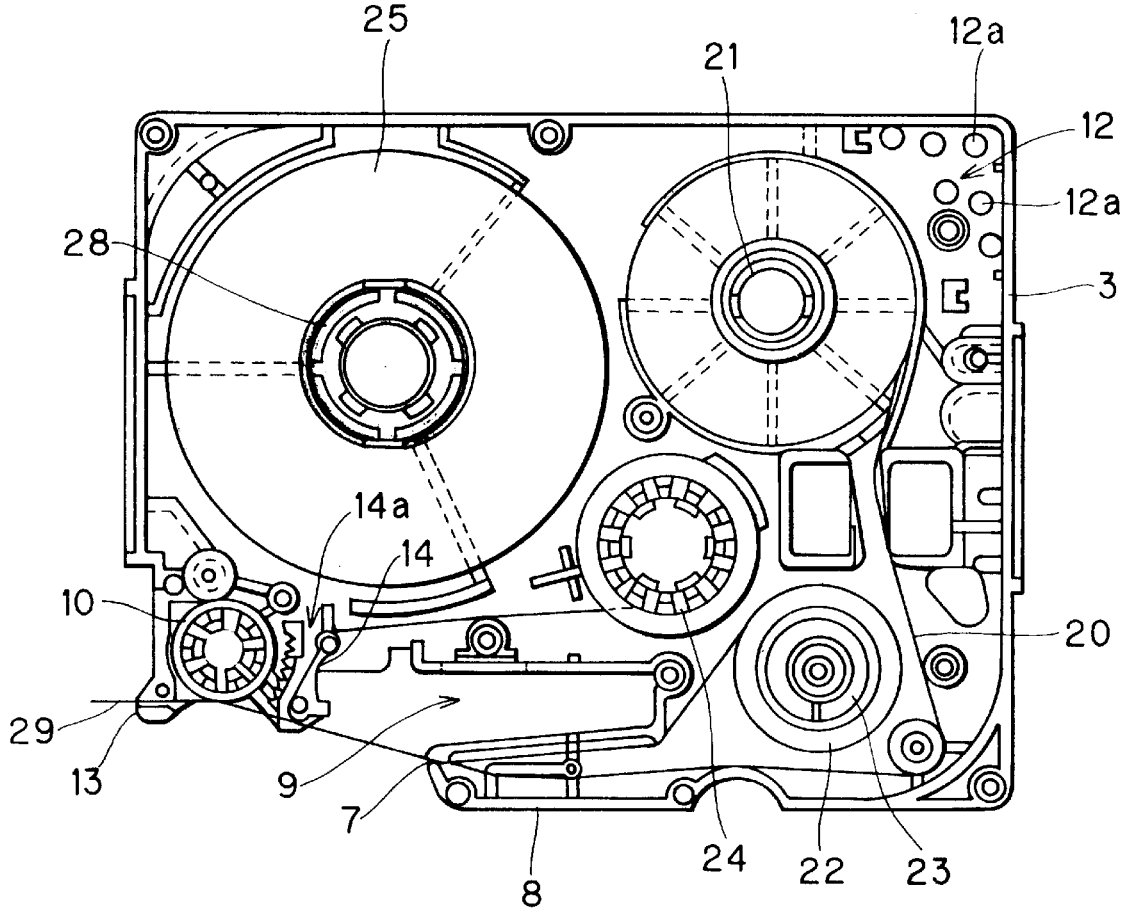
FIG. 2 is a plan view showing the tape cassette of FIG. 1 with an upper case removed to facilitate understanding.

Next, an explanation will be provided for the interior configuration of the print cassette 1 while referring to FIG. 2. FIG. 2 is a plan view of the print cassette 1 with the upper case 2 removed. As viewed in FIG. 2, the tape spool 21 on which is wrapped the transparent film tape 20 is rotatably disposed in the support hole 4 at the left upper portion of the lower case 3. The ribbon spool 23 around which is wrapped the ink ribbon 22 is rotatably disposed at the right-lower portion of the lower case 3. The ribbon take-up spool 24 for drawing ink ribbon 22 from the ribbon spool 23, and for taking up spent ink ribbon 22 after it has been used for printing characters and symbols, is rotatably disposed in the support hole 5 between the tape spool 28 and the ribbon spool 23.

The film tape 20 is drawn from the tape spool 21 by cooperative operation between the tape feed roller 10 and the pressing roller 47, which is provided to the tape printer 30, and passed below the head mounting portion 9 from the opening portion 7 of the arm portion 8. Afterward,, the film tape 20 is attached to the two-sided adhesive tape 25 and discharged out of the print cassette 1 from the tape discharge port 13. In the same manner, the ink ribbon 22 is drawn from the ribbon spool 23 via the ribbon take-up spool 24 and passed below the head mounting portion 9 from the opening portion 7 of the arm portion 8. Afterward, the ink ribbon 22 is passed through the guide hole 14*a* of the guide portion 14 and taken up on the periphery of the ribbon take-up spool 24.

Figure 3:
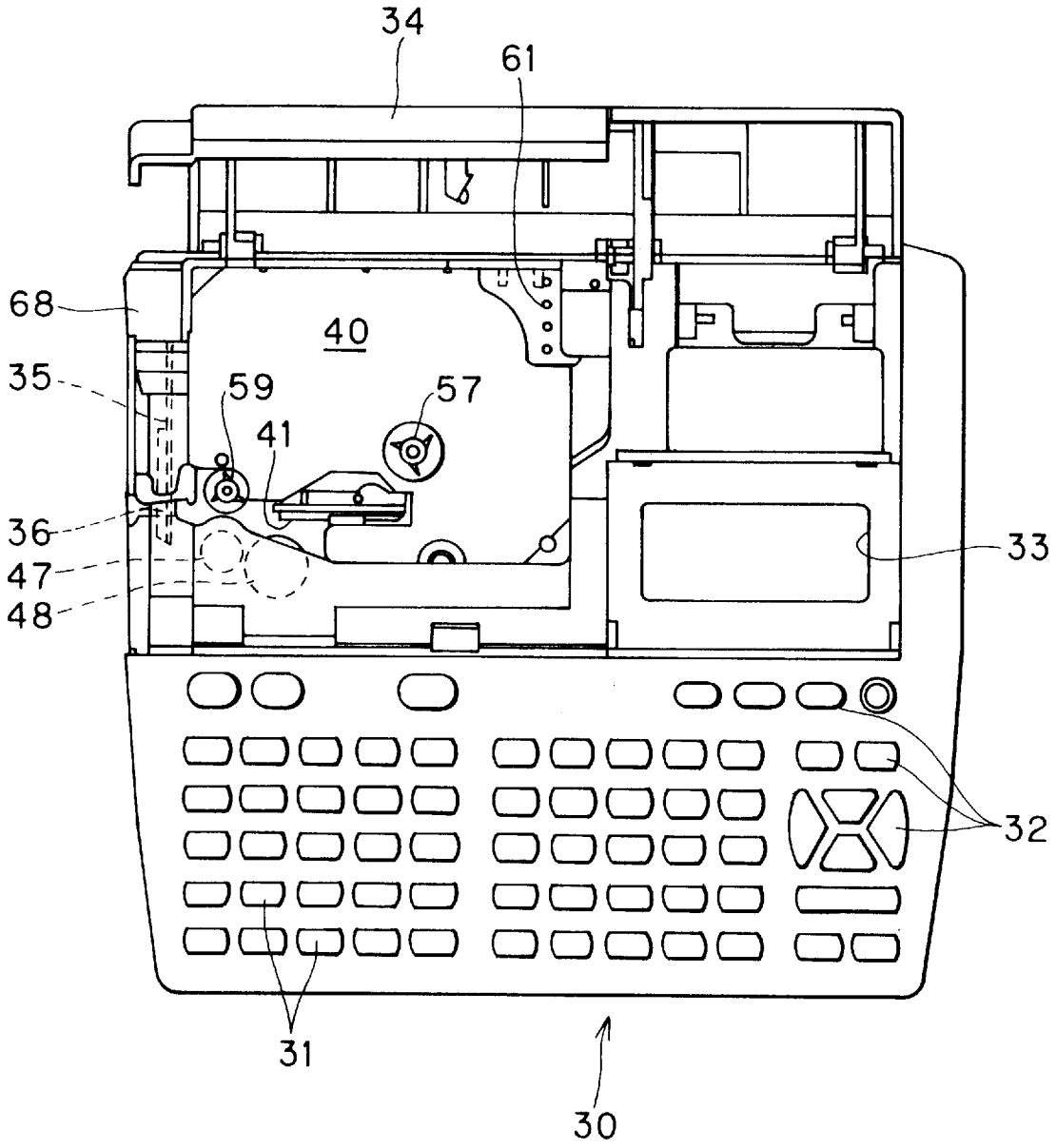
FIG. 3 is a plan view showing the tape printer in which the tape cassette of FIG. 1 is used.

Next with reference to FIG. 3, an explanation will be provided for the tape printer 30 in which is mounted the print cassette 1 to perform printing operations. The tape printer 30 includes a keyboard 31 serving as an input means for inputting characters, symbols, and the like; a liquid crystal display portion 33 serving as display means capable of displaying characters inputted by the keyboard 31; a switch panel 32 for performing various operations; a cassette mounting portion 30 capable of detachably mounting the print cassette 1; a cover body 34 capable of opening and closing to cover and expose a cassette mounting portion 40; and a cutter portion 35 for cutting printed tape 29 which has been discharged from the print cassette 1. It should be noted that the printed tape 29 is formed from the two-sided adhesive tape 25 and the film tape 20 on which has been printed characters and the like by ink ribbon 23.

A heating means for printing on the film tape 20 of the print cassette 1 and a tape transport means for discharging the printed tape 29 from the tape printer 30 are provided in the cassette mounting portion 40.

Figure 4:
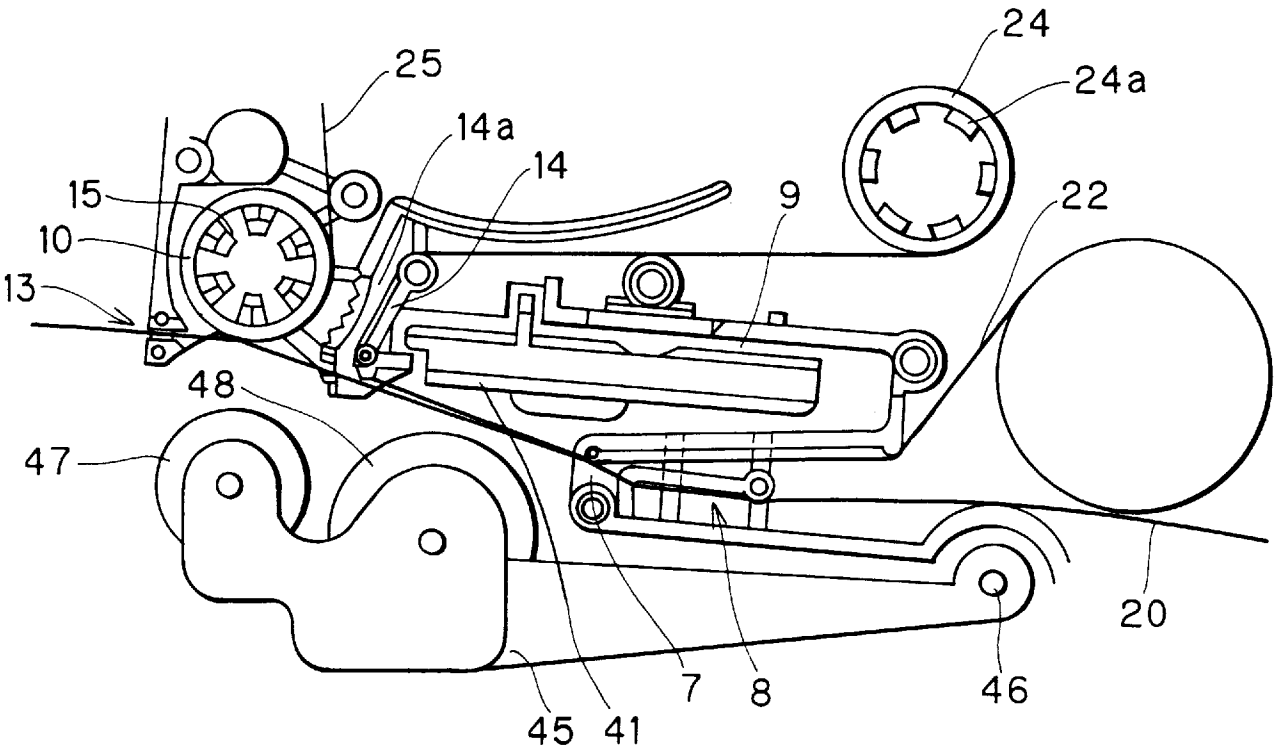
FIG. 4 is a magnified view showing: positional relationship between a thermal head of the tape printer and a head mounting portion of the print cassette; and positional relationship between the thermal head and a roller holder of the tape printer.

FIG. 4 is a magnified view showing positional relationship between the thermal head 41, which serves as the heating means when the print cassette 1 is mounted on the cassette mounting portion of the 40 of the tape printer 30, and a head mounting portion 9 provided in the print cassette 1; and the positional relationship between the thermal head 41 and the roller holder 45, which serves as a tape transport means.

The print cassette 1 is mounted in the cassette mounting portion 40 from above so that the thermal head 41 provided in the cassette mounting portion 40 is inserted through the head mounting portion 9 provided in the print cassette 1. The roller holder 45 is disposed in the cassette mounting portion 40 of the tape printer 30 and supported pivotable around a support shaft 46 in confrontation with the mounted print cassette 1. The pressing roller 47 and a platen roller 48 are rotatably supported in the roller holder 45. As described above, the pressing roller 47 operates in cooperation with the tape roller 10 to perform tape feed operations by pressing against the tape feed roller 10 when characters and symbols are printed on the film tape 20 by the ink ribbon 22 and the thermal head 41. The platen roller 48 can be pivoted with pivoting movement of the roller holder 45 to press against the thermal head 41.

Figure 5:
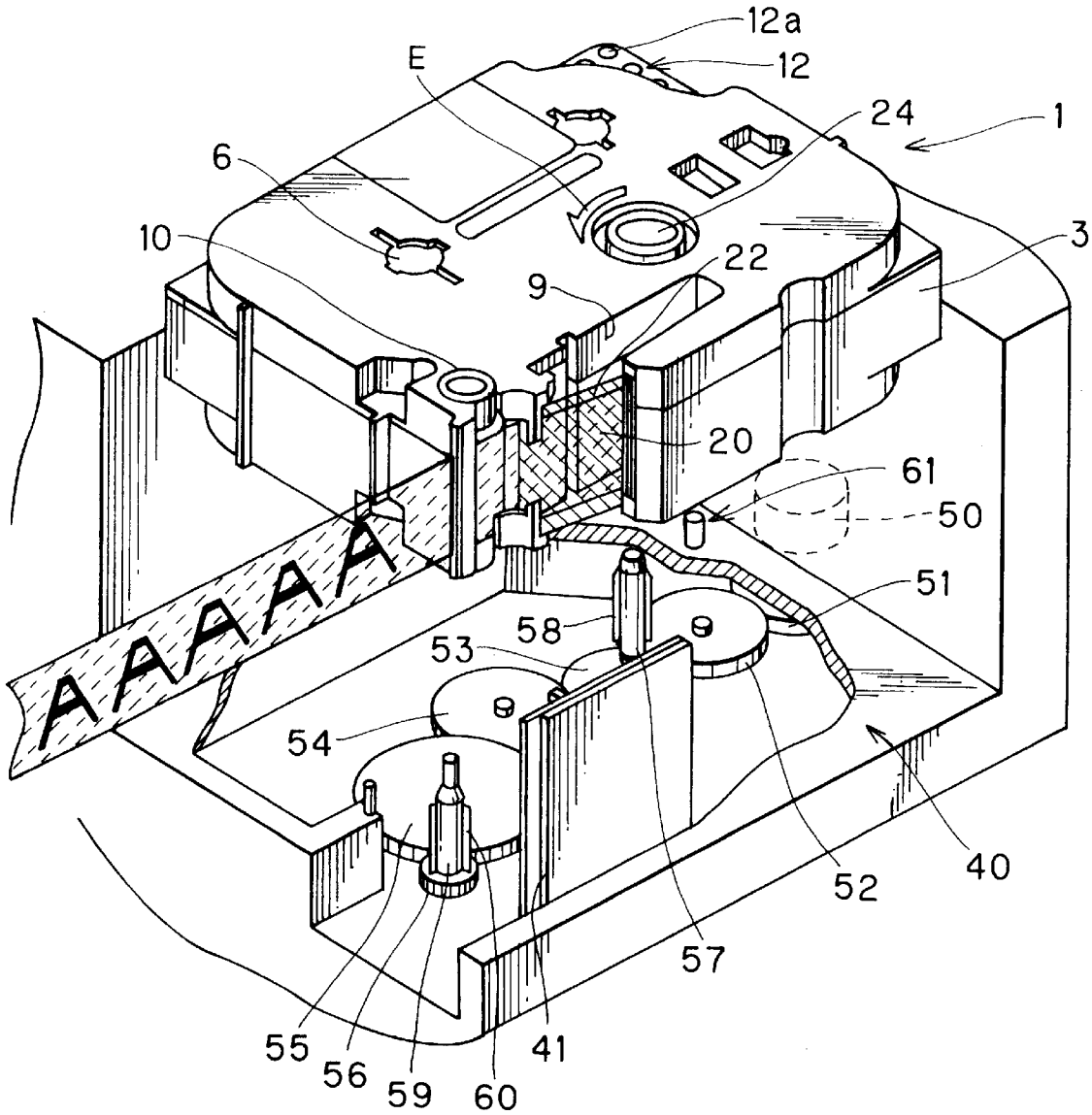
FIG. 5 is a perspective view showing the tape cassette being loaded into a cassette mounting portion of the tape printer.

FIG. 5 is a perspective view showing the print cassette 1 being loaded into the cassette mounting portion 40 of the tape printer 30. First, the configuration of the cassette mounting portion 40 will be explained as viewed in FIG. 5. The thermal head 41 is disposed at the front surface of the cassette mounting portion 40. A drive motor 50 is disposed to the center of the right outer surface of the cassette mounting portion 40. A drive gear 51 is attached to the downward protruding drive shaft of the drive motor 50. The drive gear 51 is meshingly engaged with a gear 52 rotatably supported to the base of the cassette mounting portion 40. The gear 52 is meshingly engaged with a gear 53. A ribbon take-up shaft 57 for performing rotational drive of the ribbon take-up spool 24 is disposed with an upright posture to the upper surface of the gear 53. Cam members 58 are provided around the periphery of the ribbon take-up shaft 57 for engaging with engagement ribs 24*a* formed on the inner wall of the ribbon take-up spool 24.

The gear 53 is meshingly engaged with a gear 54, the gear 54 is meshingly engaged with a gear 55, and the gear 55 is meshingly engaged with a gear 56. A tape drive cam 59 is disposed with upright posture to the gear 56. The tape drive cam 59 has cam members 60 for engaging with drive ribs 15 of the tape feed roller 10.

When the print cassette 1 is mounted to the cassette mounting portion 40 from the condition shown in FIG. 5 and the drive motor 50 is driven to rotate in the counter-clockwise direction (as viewed in FIG. 2) by the drive system described above, then the ribbon take-up shaft 57 is driven to rotate in the counter-clockwise direction by transmission of rotational drive by the drive gears 51, 52, and 53. As a result, the cam members 58 of the ribbon take-up shaft 57 and the engagement ribs 25 drive the ribbon take-up spool 24 in a direction indicated by an arrow E of FIG. 5 to take up the ink ribbon 25.

Rotation of the gear 53 drives the tape drive cam 59 to rotate in the clockwise direction (as viewed in FIG. 2) via the gear 54, the gear 55, and the gear 56. As a result, the tape feed roller 10 is driven to rotate in the clockwise direction by the cam members 60 of the tape drive cam 59 and the drive ribs 15 of the tape feed roller 10. The tape feed roller 10 in cooperation with the pressing roller 47 presses the film tape 20 against the two-sided adhesive tape 25 while discharging the resultant tape out of the tape print cassette 1 through the tape discharge portion 13. Further, after being discharged from the tape discharge portion 13, the resultant printed tape is discharged out of the tape printer 30 through a tape discharge groove 36.

Figure 6:
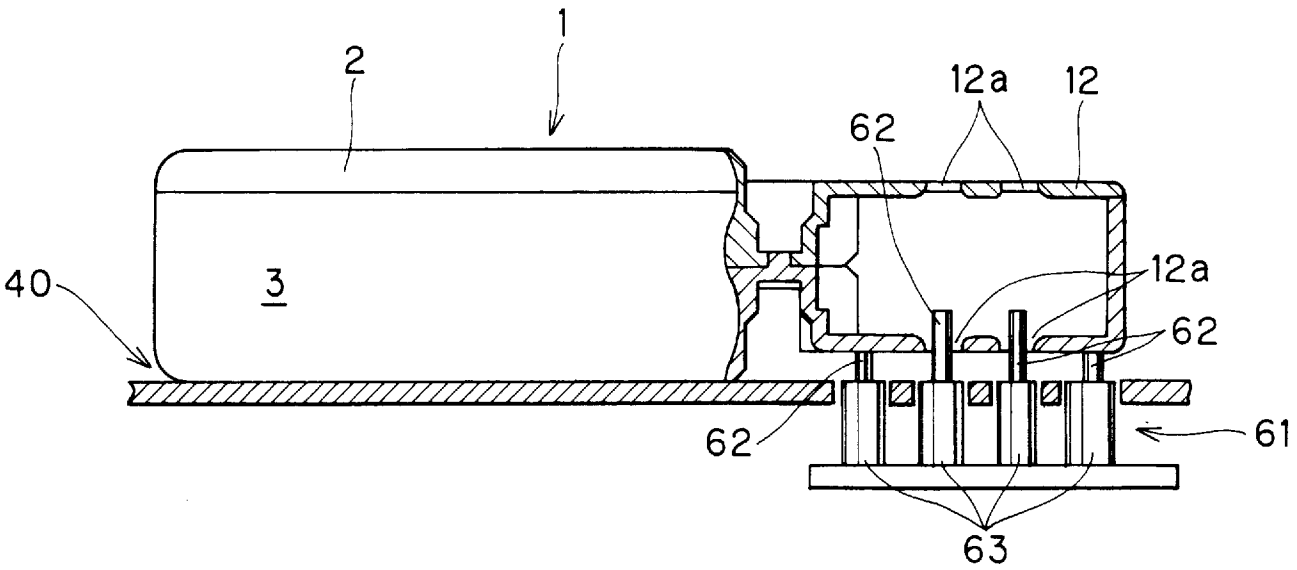
FIG. 6 is a side view in partial cross section showing components allowing the tape printer to distinguish the type of tape cassette loaded in its cassette mounting portion.

Next, the relationship between a cassette detection portion 61 and detection switches 62 when the print cassette 1 is mounted in the cassette mounting portion 41 will be described while referring to FIG. 6. As can be seen in FIG. 6, the four detection switches 62 are aligned protruding upward from switch support members 63 disposed at the rear (as viewed in FIG. 3) of the cassette mounting portion 40. Those detection switches 62 confronting a switch hole 12*a*, which as mentioned previously are formed in a predetermined pattern to the switch detection portion 12 of the print cassette 1, pass through the switch hole 12*a* and form an OFF condition. Those detection switches 62 not confronting a switch hole 12*a* are pressed downward by the switch detection portion 12 and form an ON condition. Based on the OFF and ON condition of the detection switches 62, the type of the print cassette 1 can be detected so that preparation and editing of patterns can be performed in accordance with the type of the print cassette 1 mounted in the cassette mounting portion 40.

Because the amount of energy needed to energize the thermal head varies with the type of ink ribbon, it is necessary to detect the type of ribbon used in the cassette 1. By properly detecting the type of ribbon cassette, problems that would occur when the amount of energy energizing the thermal head is too large, such as melting the ribbon or smudging of printed characters, and also problems that would occur when too little energy is used to energize the thermal head, such as scratchy characters, will not arise and an optimum energy can be applied for printing on the film tape 20.

In the example shown in FIG. 6, of the four detection switches 62, the two middle switches are turned OFF and the two edge switches are turned ON. As a result, the detection switches 62 have an ON and OFF pattern, from the left as viewed in FIG. 6, of ON, OFF, OFF, ON. Based on this combination of ON and OFF signals, the type of print cassette 1 can be detected.

Figure 7:
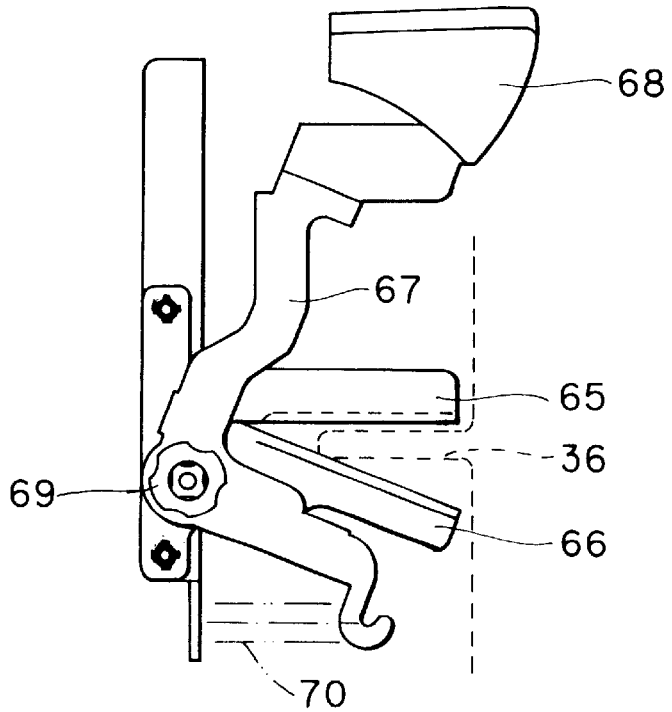
FIG. 7 is a side view showing a cutter portion of the tape printer when the cutter portion is in its normal condition.
Figure 8:
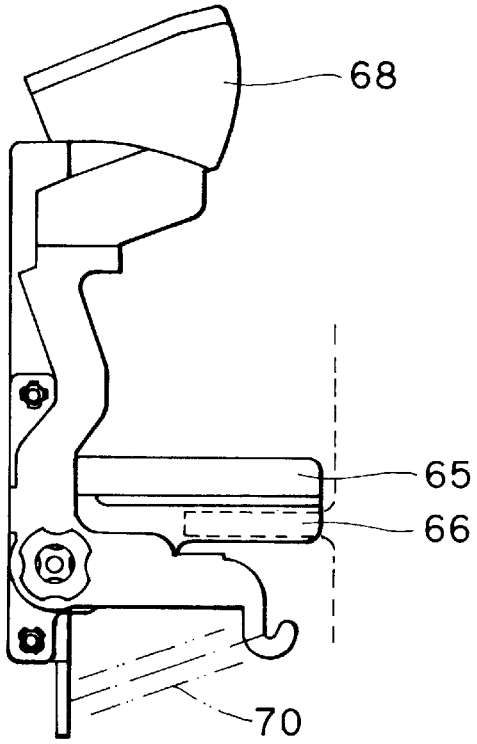
FIG. 8 is a side view showing the cutter portion when the cutter portion is in its cutting condition for cutting tapes printed in the tape printer.

Next, an explanation will be provided for using the cutter portion while referring to FIGS. 7 and 8. The cutter portion includes a fixed cutter blade 65 and a movable cutter blade 66. A connection member 67 is connected to one tip thereof with the movable cutter blade 66 and an opposite tip thereof with a cutter lever 68. Therefore, by manipulating the cutter lever 68, the connection cutter 67 can be pivoted around its central rotation shaft 69 to move the movable cutter blade 66. When the movable cutter blade 66 is moved toward the fixed cutter blade 65, a printed tape discharged from the tape printer 30 through the discharge groove 36 will be cut off. FIG. 7 shows the movable cutter blade 66 in its normal condition and FIG. 8 shows the movable cutter blade 66 in its operated condition to cut a printed tape. A pulling spring 70 is provided for urging the connection member 67 to pivot in the clockwise direction (as viewed in FIGS. 7 and 8). Therefore, after the cutter lever 68 has been operated, the connection member 67 will be urged to return to its normal condition shown in FIG. 7.

Next, a stencil cassette 81 in which is used thermal stencil paper 82 will be explained while referring FIGS. 9 and 10. FIG. 10 is a cross-sectional view showing the thermal stencil paper 82. The thermal stencil paper 82 is configured with a thermal plastic film 83; a porous support film 84; and an adhesive layer 85 for adhering the thermal plastic film 83 to the porous support film 84. The thermal plastic film 83 is formed from a film of a thermal plastic composite resin material to a thickness of between 1 to 4 $\mu$m, or more desirably 2 $\mu$m. Examples of the thermal plastic composite resin include polyethylene terephthalate, polypropylene, and a compound formed from vinylidene chloride and vinyl chloride.

It should be noted that forming the thermal plastic film 83 to 1 $\mu$m or less thickness is expensive and the resultant film will be too weak for practical application. On the other hand, if the thermal plastic film 83 were formed to 4 $\mu$m or greater thickness, a great deal of energy would be required to form holes therein, so that a normal type of thermal head with an output rating of 50 mJ/mm$^2$ would be insufficient for this task.

The porous support film 84 is made from porous thin sheets made mainly from natural fibers, such as manila hemp, paper mulberry (Broussonetia kazinoki), and mitsumata (Edgeworthia papyrifera); synthetic fibers, such as polyethylene terephthalate, polyacrylonitrile, and polyvinyl alcohol; or semi-synthetic fibers such as rayon.

Next, an explanation will be provided for the stencil cassette 81 in which is used in the thermal stencil sheet 82. As shown in FIG. 9, the stencil cassette 81 includes the upper case 2 and the lower case 3 used in the print cassette 1. The stencil cassette 81 is therefore also detachably mountable in the cassette mounting portion 40 of the tape printer 30. Said differently, the stencil cassette 81 and the print cassette 1 have the same shape as far as their mountability to the cassette mounting portion 40 is concerned.

In contrast with the print cassette 1, no ink ribbon 22, ribbon spool 23, ribbon take-up spool 34, film tape 20, or tape spool 21 are provided to the stencil cassette 81. Also, in place of the two-sided adhesive tape 25, the thermal stencil paper 82 is wrapped around the tape spool 28 so that the thermal plastic film 83 of the thermal stencil paper 82 faces inward. Also, the pattern of the switch holes 12*a* formed in the switch detection portion 12 differs between the stencil cassette 81 and the print cassette 1. The detection portions are the only external portions that differ between the stencil cassette 81 and the print cassette 1.

The thermal stencil paper 82 is drawn from the tape spool 28, passes through the inside of the arm portion 8, through the opening 7 of the arm portion 8, and through the tape discharge portion 13.

The stencil cassette 81 is mounted in the cassette mounting portion 40 of the tape printer 30 in the same manner as with the print cassette 1. When the thermal stencil paper 82 is transported by cooperative operation of the tape feed roller 10 and the pressing roller 47, the thermal head 41 heats up and selectively melts holes in the thermal plastic film 83 of the thermal stencil paper 82 passing in confrontation with the thermal head 41. In this way, characters and other patterns can be formed in the thermal stencil paper 82 from perforations formed by the thermal head 41. Afterward, the thermal stencil paper 82 is discharged through the tape discharge portion 13 and out of the stencil cassette 81.

When too great an energy is used to heat the thermal head 41 to form holes in the thermal stencil paper 82, then the melted thermal plastic film 83 can cling to the thermal head 41. This can result in the thermal head 41 being unable to form holes in the thermal plastic film 83 so that portions of the thermal stencil paper 82 in which holes are desired to be formed may not be formed with holes.

On the other hand, when too small an energy is used to heat the thermal head 41, then the size of holes formed in the thermal stencil paper 82 can vary or the thermal head 41 can fail to open holes in a desired portion of the thermal stencil paper 82. Because the pattern of the switch holes 12*a* formed in the switch detection portion 12 of the stencil cassette 81 indicates that the stencil cassette 81 is mounted in the cassette mounting portion 40, the tape printer 30 automatically sets the energizing energy of the thermal head 41 to an optimum setting to prevent melted thermal plastic film 83 from clinging to the thermal head 41 and to prevent failure to open holes in the thermal stencil paper 82.

Figure 9:
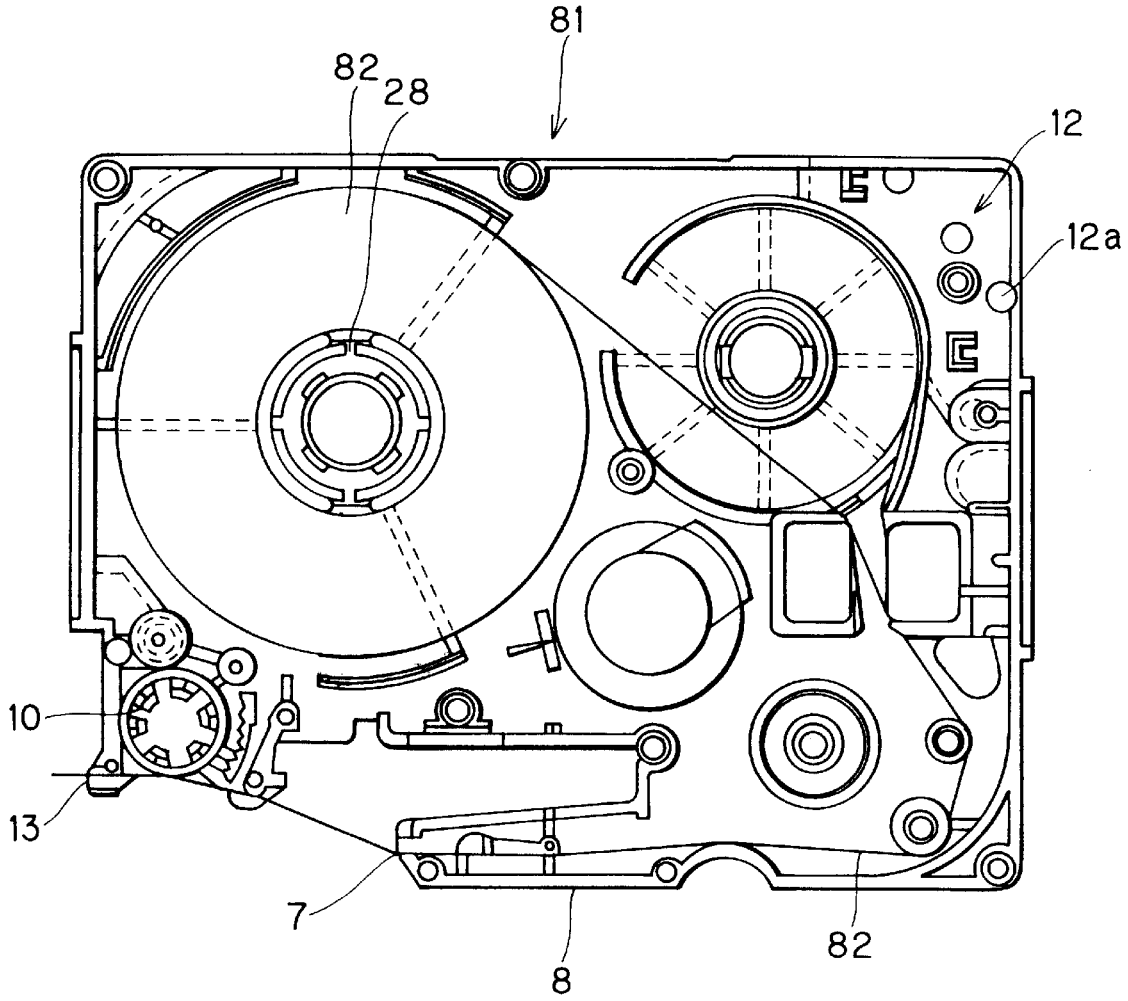
FIG. 9 is a plan view showing a stencil cassette according to the present invention with an upper case removed to facilitate understanding.
Figure 10:
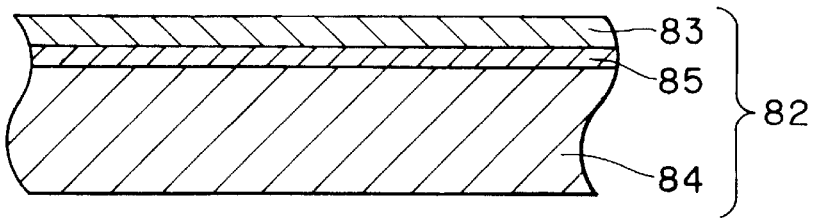
FIG. 10 is a cross-sectional view showing thermal stencil paper used in the stencil cassette of FIG. 9.

It should be noted that although the example shown in FIG. 9 shows the thermal stencil paper 82 replacing the two-sided adhesive tape 25 of the print cassette 1, instead the thermal stencil paper 82 could be wrapped around the tape spool 21 instead of the film tape 20.

The stencil cassette 81 with the above-described configuration is mounted in the tape printer 30. After the thermal stencil paper 82 is formed with a pattern of characters and the like, it is cut to a predetermined length by the cutter portion of the tape printer 30 in the same manner as when cutting a printed print tape 29 from the print cassette 1.

Figure 11:
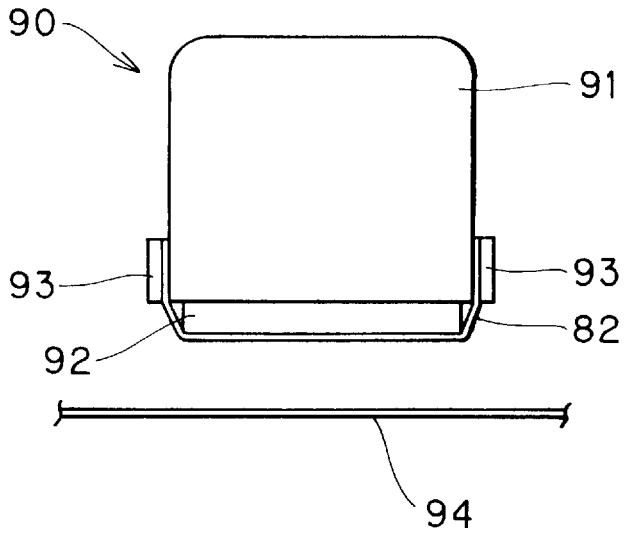
FIG. 11 is a schematic view showing a stamp unit attached with the thermal stencil paper formed with a stencil pattern.

FIG. 11 shows a stamp unit 90 to which the thermal stencil paper 82 formed with a stencil pattern can be attached. The stamp unit 90 includes a grip 91; an ink-impregnated body 92 impregnated with ink; and fixing members 93 for fixing the thermal stencil paper 82 so that the porous support film 84 is in contact with the ink-impregnated body 92.

To print a stamp using the stamp unit 90 attached with the thermal stencil paper 82, the user grasps the grip portion 91 and presses the thermal stencil paper 82 against a sheet 94 on which the stencil image is desired to be stamped. This pressing action squeezes the ink-impregnated body 92 between the grip portion 91 and the sheet 94. Ink from the ink-impregnated body 92 seeps from stencil holes perforated in the thermal stencil paper 82. In this way, the stamp unit 90 and the thermal stencil paper 82 can be used to print the same stencil image for a plurality of times on the surface of the sheet 94.

Because the stencil pattern formed in the thermal stencil paper 82 appears in mirror image and because the pattern is formed in the thermal plastic film 83, which is transparent, it is difficult for users to confirm the stencil pattern formed in the thermal stencil paper 82. However, because the pattern can be prepared in the tape printer 30, the user can print the pattern using the print cassette 1 beforehand and confirm that the pattern is as desired. No special thermal paper needs to be provided to confirm the pattern. If the pattern is confirmed to be as desired, then the printed tape from the print cassette 1 can be attached to the top of the stamp unit 90 and serve as an indication of the stencil pattern that can be stamped using the stamp unit 90.

Because the thermal stencil paper is provided to the tape cassette of the present invention, the tape cassette can be mounted in the cassette mounting portion of a tape printer. Therefore, the thermal stencil paper can be formed with a desired stencil pattern without using a special stencil preparation unit.

Because the tape cassette can be used with conventional tape printers, there is no need to learn new complicated operations. Also, the stencil image prepared using the conventional tape printer can be confirmed by first printing the image on a print tape housed in the tape cassette. There is no need to separately purchase and install thermal sheets for confirming the stencil pattern. Also, the stencil pattern need not be confirmed using the thermal stencil paper formed with a mirror image of the stencil pattern.

Because the tape cassette housing a thermal stencil paper has the same shape as a tape cassette housing a print tape and an ink ribbon, there is no need to produce a new tape cassette for use with the thermal stencil paper. Also, no new components need to be used to mount the tape cassette to a tape printer. Because the switch holes formed in the switch detection portion distinguish that the tape cassette houses thermal stencil paper and not a print tape or an ink ribbon, the tape printer can confirm that the tape cassette houses the thermal stencil paper. Therefore, the tape printer can automatically control the print means as required to optimally form holes in the thermal stencil paper.

Because the thermal stencil paper is housed in a portion of the tape cassette corresponding to the portion housing the two-sided adhesive tape, a large amount of thermal stencil paper can be housed in the tape cassette.

While the invention has been described in detail with reference to specific embodiments thereof, it would be apparent to those skilled in the art that various changes and modifications may be made therein without departing from the spirit of the invention, the scope of which is defined by the attached claims.

For example, the stencil cassette 81 need not have the exact same shape as the print cassette 1 as long as a portion of the case is the same so that the stencil cassette 81 is mountable in the cassette mounting portion 40 and usable with some of the cams 59, shafts 57, rollers 47, 48, and other components for transporting any of the film tape 20, the ink ribbon 22, the print tape 29, or, as in the above-described embodiment, the two-sided adhesive tape 25 in the tape printer 30.

What is claimed is:

1. A combination of a print device and cassettes used in the print device, comprising:

a tape cassette including:

a print tape; and a print tape case housing the print tape and having a portion with a predetermined shape;

a thermal stencil paper; and a stencil sheet case housing the thermal stencil paper and having a portion with the predetermined shape; and a print device including:

a cassette mounting portion for detachably receiving the portions with the predetermined shape;

a thermal print means provided in the tape mounting portion for thermally printing characters and symbols on the print tape and thermally perforating characters and symbols in the thermal stencil paper;

a transport means for transporting the print tape in the tape cassette and the thermal stencil paper in the stencil sheet cassette;

a cassette identifying means for identifying which of the tape cassette and the stencil sheet cassette is mounted in the cassette mounting portion; and means for applying energy to the thermal print means according to the identified one of the tape cassette and the stencil sheet cassette.

2. A combination as claimed in claim 1, wherein the cassette identifying means includes:

a first identifying portion formed in the tape cassette;

a second identifying portion formed in the stencil sheet cassette and differing from the first identifying portion; and a detector portion provided to the print device for detecting the first identifying portion when the tape cassette is mounted in the cassette mounting portion and for detecting the second identifying portion when the stencil sheet cassette is mounted in the cassette mounting portion.

3. A combination as claimed in claim 2, wherein:

the detector portion includes a plurality of detectors each having a switch urged to protrude from its detector;

the first identifying portion is formed with at least one hole at a position corresponding to one of the switches so that the one of the switches protrudes through the at least one hole when the tape cassette is mounted in the cassette mounting portion; and the second identifying portion is formed with at least another hole at another position corresponding to another one of the switches so that the another one of the switches protrudes through the at least another hole when the stencil sheet cassette is mounted in the cassette mounting portion.

4. A combination as claimed in claim 2, wherein the print tape case of tape cassette has the same shape as the stencil sheet case of the stencil sheet cassette except that the first identifying portion differs from the second identifying portion.

5. A combination as claimed in claim 1, wherein:

the transport means includes cams rotatably provided in the cassette mounting portion;

the tape cassette is formed at the portion with holes at positions corresponding to the cams of the transport means; and the stencil sheet cassette is formed at the portion with holes at the positions corresponding to the cams of the transport means.

6. A combination as claimed in claim 1, wherein the print tape includes:

a film tape;

an ink ribbon; and a two-sided adhesive tape;

the tape case includes:

a film tape housing portion for housing the film tape;

an ink ribbon housing portion for housing the ink ribbon; and a two-sided adhesive tape housing portion for housing the two-sided adhesive tape; and the stencil sheet case of the cassette includes a stencil sheet housing portion, for housing the stencil sheet, corresponding to the two-sided adhesive tape housing portion of the tape cassette.

7. A cassette as claimed in claim 1, wherein the print tape of the tape cassette includes a film tape, an ink ribbon, and a two-sided adhesive tape, and the tape case of the tape cassette includes a film tape housing portion for housing the film tape, an ink ribbon housing portion for housing the ink ribbon, and a two-sided adhesive tape housing portion for housing the two-sided adhesive tape, wherein:

the stencil sheet case of the cassette includes a stencil sheet housing portion, for housing the stencil paper, corresponding to the two-sided adhesive tape housing portion of the tape cassette.

8. The combination of claim 1, wherein the stencil sheet case includes holes formed in a predetermined pattern for allowing the cassette identifying means to identify which of the tape cassette and the stencil sheet cassette is mounted in the cassette mounting portion.

9. A tape printer, comprising:

a cassette mounting potion for detachably receiving one of a print tape cassette and a stencil sheet cassette;

a thermal print head for thermally printing characters and symbols on print tape housed in the print tape cassette and for thermally perforating characters and symbols in thermal stencil paper housed in the stencil sheet cassette;

a tape feeder for transporting the print tape in the tape cassette and the thermal stencil paper in the stencil sheet cassette;

a cassette identifier for identifying which of the tape cassette and the stencil sheet cassette is mounted in the cassette mounting portion; and means for applying energy to the thermal print head according to the type of cassette identified by the cassette identifier.

10. The tape printer of claim 9, wherein the energy applying means applies a first energy level to the thermal print head when a tape cassette is mounted in the cassette mounting portion and applies a different, second energy level to the thermal print head when a stencil sheet cassette is housed in the cassette mounting portion.

* * * * *